United States Patent [19]

Quilliou

[11] Patent Number: 5,038,916

[45] Date of Patent: Aug. 13, 1991

[54] TRANSFER ASSEMBLY FOR FREEZER

[75] Inventor: Guy Quilliou, Niort, France

[73] Assignee: Pierre Guerin S.A., Mauze-sur-le-Mignon, France

[21] Appl. No.: 522,536

[22] Filed: May 11, 1990

[30] Foreign Application Priority Data

May 22, 1989 [FR] France ..... 89 06641

[51] Int. Cl.[5] ..... B65G 25/08

[52] U.S. Cl. ..... 198/429; 198/468.11; 198/464.4; 198/719; 198/747

[58] Field of Search ..... 198/429, 430, 468.9, 198/468.1, 468.11, 464.4, 719, 736, 738, 739, 740, 747, 748

[56] References Cited

U.S. PATENT DOCUMENTS

| | | | |
|---|---|---|---|
| 1,906,605 | 5/1933 | Hutchinson | 198/430 |
| 2,736,417 | 2/1956 | Greer | 198/430 |
| 2,842,253 | 7/1958 | Amerio et al. | 198/430 |
| 2,929,491 | 3/1960 | Candido, Jr. | 198/719 X |
| 3,198,309 | 8/1965 | Ogawa | 198/430 X |
| 3,244,266 | 4/1966 | Zappia et al. | 198/430 |
| 3,774,754 | 11/1973 | Hedlund | 198/748 X |
| 3,779,362 | 12/1973 | Horn | 198/464.4 |
| 4,003,464 | 1/1977 | Zappia | 198/430 |
| 4,253,560 | 3/1981 | Cross et al. | 198/464.4 X |

*Primary Examiner*—D. Glenn Dayoan
*Attorney, Agent, or Firm*—Kurt Kelman

[57] ABSTRACT

An apparatus for charging products to be frozen onto a freezer plate comprises a conveyor arranged to place the products in front of a charging opening of a freezer, and a device for transferring the products in a translatory movement from the conveyor through the charging opening onto the freezer plate. To obtain a strong transfer force and effective control, the transferring device comprises a pusher bar arranged to engage the products to be frozen on the conveyor, a chain drive arranged to impart the translatory movement to the pusher bar engaging the products, the chain drive comprising chains to which the pusher bar is attached and driving pinions about which the chains are trained, the chains having links short enough to enable the chains to engage the pinions over about a quarter of a circle and the pinions being affixed to a rotary shaft, a reduction brake motor floatingly mounted on the rotary shaft and comprising a return arm. The motor is coupled to the shaft, and a dynamometer connects the return arm to a support frame for the conveyor.

6 Claims, 2 Drawing Sheets

TRANSFER ASSEMBLY FOR FREEZER

BACKGROUND OF THE INVENTION

1. Field of the Invention

The present invention relates to an apparatus for charging products to be frozen onto a freezer plate extending in a horizontal plane and arranged in a freezer housing defining a charging opening in this plane.

2. Description of the Prior Art

Freezers which comprise a stack of horizontally extending hollow freezer plates, through which a refrigerant fluid circulates and which are vertically movably mounted in an insulated freezer housing are well known. The freezer housing has a front wall and a rear wall respectively defining a charging opening for receiving the products to be frozen from a charging conveyor and a discharge opening through which the frozen products are discharged onto a discharge conveyor. Means is provided for vertically displacing the stack of freezer plates in increments to move the freezer plates successively to the level of the openings and for transferring the products to be frozen from the charging conveyor through the charging opening onto the freezer plate moved to this level and for simultaneously transferring the frozen products from this freezer plate through the discharge opening onto the discharge conveyor. The charging conveyor is normally a horizontally extending endless conveyor belt and a pusher bar transfers the products to be frozen from the conveyor belt to the freezer plate. These products are arrayed on the conveyor belt side-by-side in a row and the length of the row is equal to the useful width of the freezer plate so that all the products are charged at the same time as the pusher bar pushes the row of products through the charging opening. As the row of products is pushed in through the charging opening in the front wall of the freezer housing, a row of frozen products at the other end of the freezer plate is simultaneously pushed out through the discharge opening in the rear wall, rows of products being arranged side-by-side on the freezer plate in a continuous freezing operation The translatory movement of the pusher bar required for charging and discharging row after row of products is relatively short. However, the pusher bar is generally also used for completely emptying the freezer before stopping the freezing operation, for example to defrost the freezer. Therefore, the translatory movement stroke of the pusher bar must exceed the length of the freezer plates (3 to 4 meters). For this reason, it is not possible to use conventional jacks for driving the pusher bar and, generally, special drive chains are utilized, which curvilinearly extend in only one direction from their rectilinear course so that they may exert traction as well as pushing forces under certain operating conditions. These chains, like racks, are moved by sprocket gears which engage the rectilinear and horizontal section of the chains, and the ends of the chains are attached to the pusher bar. Behind the sprocket gears, the chains are guided in shafts which are upwardly curved to reduce obstruction. The sprocket gears engage the chains only with one or two gear teeth and, therefore, the force they can exert upon the pusher bar is limited. However, sometimes it is necessary to exert considerable pushing force upon the bar to detach the frozen products from the freezer plate before charging the plate again, and this may be impossible with an arrangement such as disclosed, for example, in U.S. Pat. No. 3,557,975.

SUMMARY OF THE INVENTION

It is the primary object of this invention to overcome this disadvantage and to provide a translatory transfer apparatus of the first-described type, in which a sufficient moving force can be applied to the pusher bar without unduly increasing the dimensions of the apparatus components and which enables this force to be controlled and, if necessary, to be limited to an acceptable value.

The invention accomplishes this and other objects in such an apparatus which comprises a conveyor means arranged to place the products to be frozen in front of the charging opening, and means for transferring the products to be frozen in a translatory movement from the conveyor means through the charging opening onto the freezer plate. According to the present invention, the transferring means comprises a pusher bar arranged to engage the products to be frozen on the conveyor means, a chain drive arranged to impart the translatory movement to the pusher bar engaging the products to be frozen, the chain drive comprising chains to which the pusher bar is attached and driving sprocket gears about which the chains are trained, the chains having links short enough to enable the chains to engage the sprocket gears over about a quarter of a circle and the sprocket gears being affixed to a rotary shaft, a reduction brake motor floatingly mounted on the rotary shaft and comprising a return arm coupled to the shaft, and a dynamometer connecting the return arm to the freezer housing.

According to a preferred feature of this invention, the dynamometer is constituted by a pneumatic jack and means for measuring the air pressure in the jack determine torque of the motor and, consequently, the force applied to the pusher bar. Means for controlling the alternating movements of the pneumatic jack may be provided to cause the shaft of the sprocket gears to rotate while the motor brake is tightened so that the pusher bar advances only a short distance.

The chains define a course extending in the horizontal plane and the sprocket gears are spaced from the conveyor means in this plane, and the apparatus may further comprise rectilinear guides supporting the chains between the sprocket gears and the conveyor means, the rectilinear guides being mounted rotatively about the rotary shaft, and means for turning the rectilinear guides about the rotary shaft and thereby to lift the chains and the pusher bar attached thereto above said horizontal plane. These rectilinear guides may be affixed to a tube coaxially surrounding the rotary shaft and being rotatable thereabout, and the turning means may comprise a jack and an arm affixed to the rotatable tube and connected to the jack. This arrangement enables a new row of products to be frozen to be conveyed in front of the charging opening of the freezer by means of the conveyor means before the pusher bar has been completely retracted in its translatory movement and while it has been raised above the products on the conveyor means.

BRIEF DESCRIPTION OF THE DRAWING

The above and other objects, advantages and features of the invention will become better understood from the following detailed description of a now preferred embodiment thereof, taken in conjunction with the accompanying, somewhat schematic drawing wherein.

DETAILED DESCRIPTION OF PREFERRED EMBODIMENT

Figure 1:
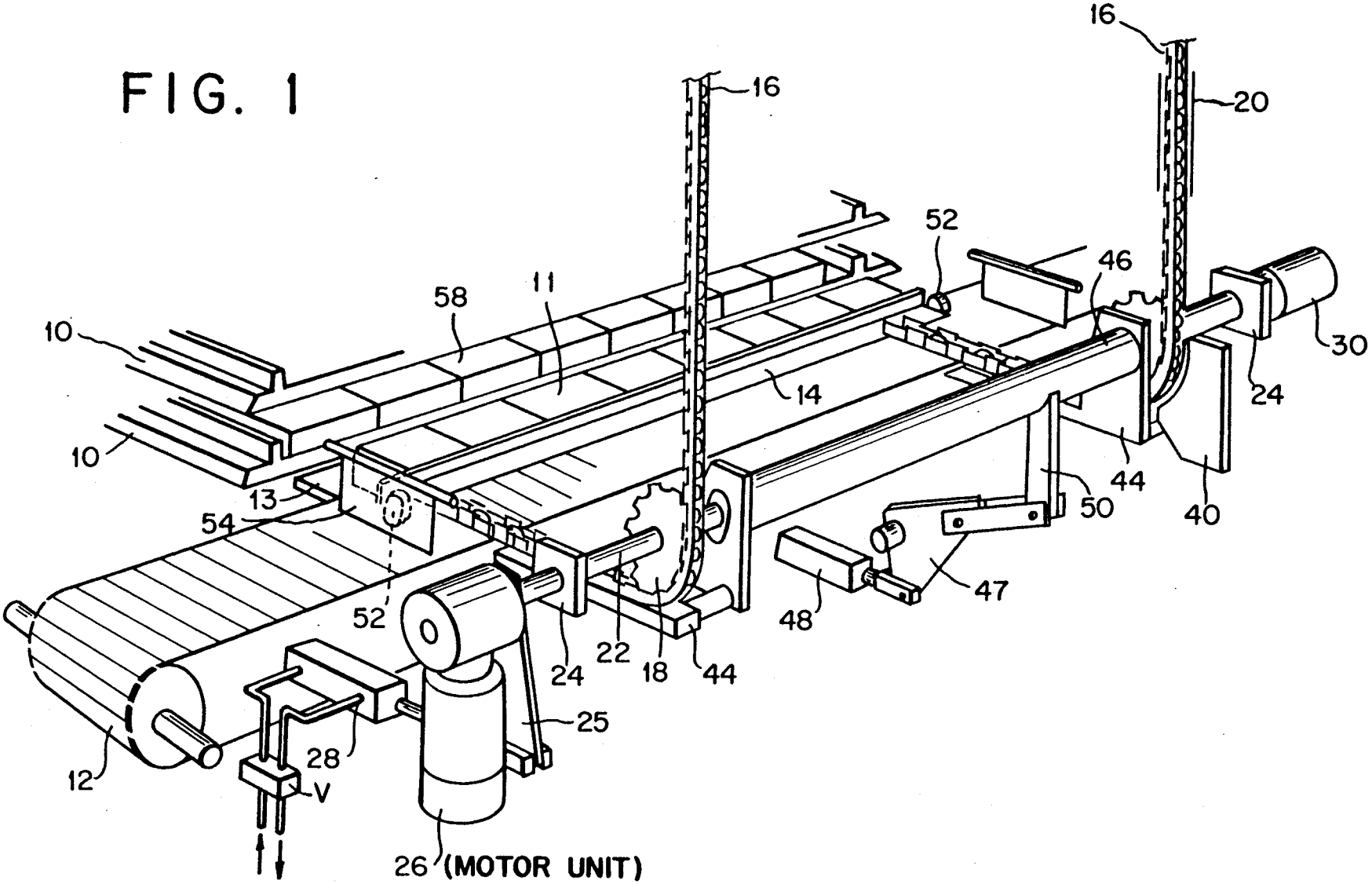
FIG. 1 is a perspective view of an apparatus for charging and discharging a freezer plate according to the present invention, the housing of the freezer not being shown for sake of clarity.

Referring now to the drawing and first to FIG. 1, there is shown an apparatus for charging products 11 to be frozen onto a freezer plate 10 extending in a horizontal plane and arranged in a freezer housing defining a charging opening in said plane. Since freezers with an insulated freezer housing whose front and rear walls define a charging opening and a discharge opening, respectively, are well known, the freezer housing has not been illustrated for the sake of clarity of the drawing, and the vertical stack of freezer plates inside the freezer housing has been represented only by two superposed freezer plates 10. The means for incrementally raising the stack of freezer plates so that one plate after another is brought to the level of the horizontal plane defined by the charging and discharge openings also has not been illustrated since such means are also conventional and form no part of the present invention.

The apparatus comprises a conveyor means illustrated as endless conveyor belt 12 arranged to place a row of products 11 to be frozen in front of the charging opening, and sheet metal element 13 extends from the endless conveyor belt to freezer plate 10 positioned in the horizontal plane to bridge the gap between the conveyor belt and the freezer plate. The apparatus further comprises means for transferring the products to be frozen in a translatory movement from conveyor belt 12 through the charging opening onto freezer plate 10. This transferring means comprises pusher bar 14 arranged to engage the row of products 11 to be frozen on the conveyor belt, and a chain drive arranged to impart the translatory movement to pusher bar 14 engaging the products to be frozen. The chain drive comprises a pair of chains 16 to one end of which pusher bar 14 is attached and driving sprocket gears 18 about which the chains are trained. Chains 16 have links 32 short enough to enable the chains to engage the sprocket gears over about a quarter of a circle. Sprocket gears 18 are affixed to a rotary shaft 22 journaled in fixed bearings 24. The support frame for the apparatus, on which these fixed bearings and other fixed structures of the apparatus are mounted, has not been illustrated for the sake of clarity, such support frames being entirely conventional. The chains must be long enough to permit pusher bar 14 to be displaced along the entire length of freezer plate 10, which may be in excess of 3 m.

Reduction brake motor unit 26 is floatingly mounted on one end of the rotary shaft and comprises a return arm 25, the motor unit being coupled to shaft 22, and fixed dynamometer 28 connects the return arm to the support frame which, as shown, also supports endless conveyor belt 12. Unit 26 consists of a two-speed electric motor, a reduction gear and a brake. The inlet shaft of the reduction gear is coupled to the motor shaft and the outlet shaft of the gear is coupled to driven rotary shaft 22. A brake is mounted on the motor shaft or on the outlet shaft to hold the same stationary when the motor is not energized. Unit 26 is made integral with rotary shaft 22 when the brake is tightened so that the rotary shaft may be rotated by dynamometer 28 which, in the illustrated embodiment, is constituted by a pneumatic jack provided with means for measuring the air pressure in the jack. Encoder 30 is mounted on the opposite end of rotary shaft 22 and enables the number of turns of the shaft, or fractions thereof, to be counted, thus measuring the stroke of displacement of pusher bar 14 during its translatory movement.

Chain links 32 have abutment faces 34 which, when the chain links are in rectilinear alignment, abut each other and permit relative pivoting of the chain links only in one direction, i.e. the one enabling the chains to curve around sprocket gears 18. The chains are equipped with rollers 36 mounted on axles of articulation 38 and engaging the teeth of the sprocket gears. As shown in FIG. 1, the peripheral portion of sprocket gears 18 engaged by the chains is surrounded by fixed guideway 40 (only one guideway being illustrated), and this guideway has an arcuate guide track on which rollers 36 roll and which absorbs the reaction forces of the chain.

Figure 2:
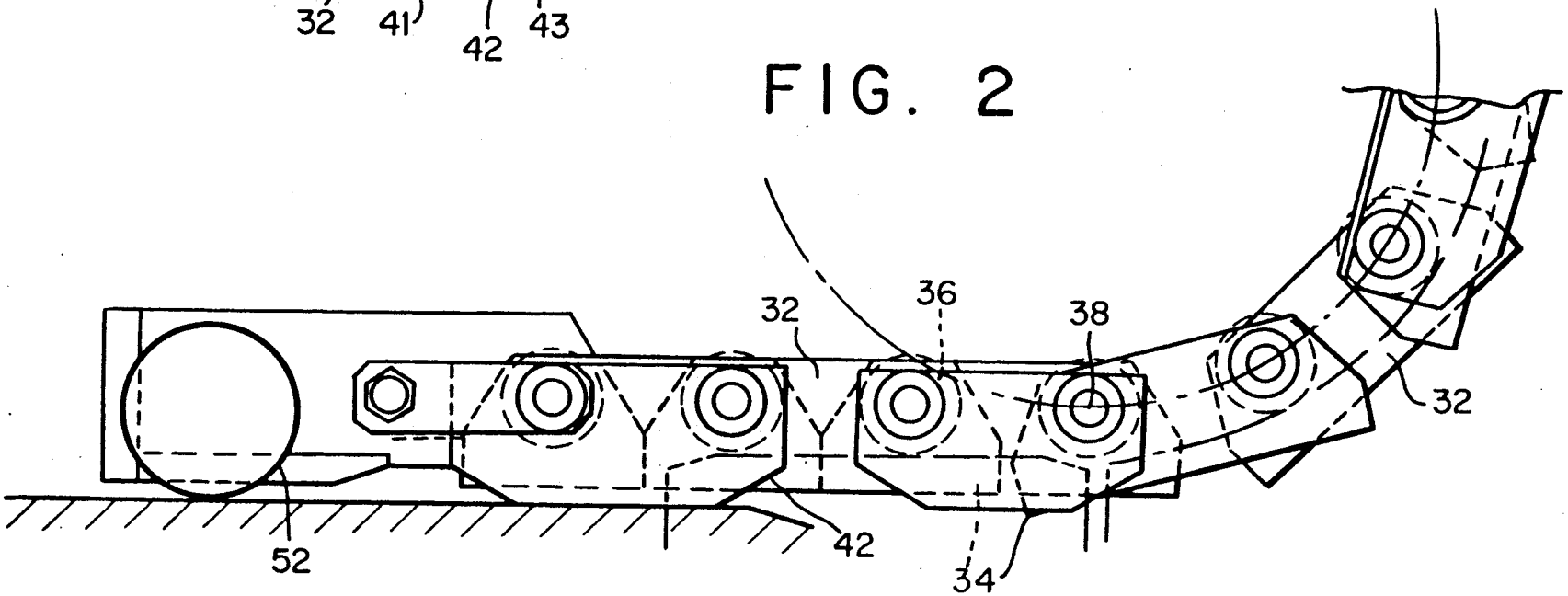
FIG. 2 is an enlarged fragmentary side elevational view of the chain drive imparting a translatory movement to the pusher bar of the apparatus.
Figure 3:
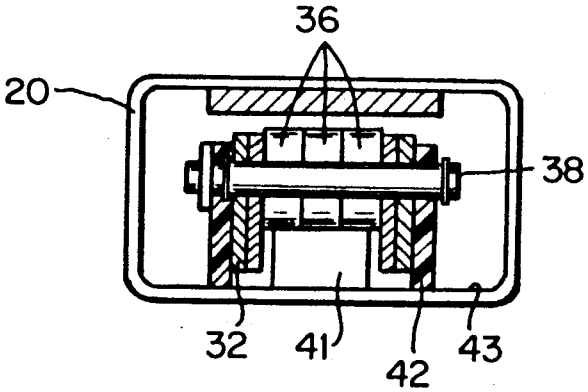
FIG. 3 is a transverse cross section of the drive chain and its guide shaft.

Chains 16 define a course extending in the horizontal plane defined by the conveyor belt and freezer plate 10 at the level of the charging and discharge openings, and are comprised of chain links 32 hinged to each other by axles of articulation 38 (see FIGS. 2 and 3). Slide blocks 42 support chains 16 along this course and are mounted on axles of articulation 38 on each side of the chain in a manner to maintain the chain links spaced from surface 43 along which they glide, the slide blocks being platelets of a synthetic resin material having a low coefficient of friction, such as Teflon. The height of slide blocks 42 exceeds that of chain links 32 so that the chain links are maintained at a distance from gliding surface 43. From the sprocket gears, the chains are vertically guided in vertical guide shafts 20 in the interior of which rollers 36 run on track 41 and slide blocks 42 glide along inner surface 43 of the guide shafts.

As shown, sprocket gears 18 are spaced from conveyor belt 12 in the horizontal plane, and rectilinear guides 44 support chains 16 between the sprocket gears and the conveyor belt, the rectilinear guides being mounted rotatively about rotary shaft 22, and means being provided for turning the rectilinear guides about the rotary shaft and thereby to lift chains 16 and pusher bar 14 attached thereto above the horizontal plane. In the illustrated embodiment, the apparatus further comprises a tube 46 coaxially surrounding rotary shaft 22 and being rotatable thereabout, rectilinear guides 44 being affixed to the rotatable tube, and the turning means comprises fixedly mounted jack 48 and arm 50 affixed to rotatable tube 46 and connected to the jack by linkage 47 including a bellcrank lever. In this way, products 11 to be frozen may be placed in the charging position on endless conveyor belt 12 while pusher bar 14 is retracted in the raised position of the chain drive and the pusher bar, thus gaining time and reducing the duration of the charging cycle.

The two opposite ends of pusher bar 14 carry rollers 52 which maintain the pusher bar at a slight distance above the surfaces along which it is displaced in a translatory movement, i.e. the conveyor belt 12, sheet metal element 13 and freezer plate 10, thereby eliminating friction.

The above-described apparatus operates in the following manner:

The freezer is in continuous operation and freezer plates 10 are always charged with products to be frozen. When a new batch of products is to be charged onto a freezer plate through the charging opening, a corresponding row of frozen products must be pushed out of the discharge opening at the opposite end of this freezer plate, as is well known in the operation of freezers of this type. Because of the formation of frost during the freezing operation, frozen products 58 tend to adhere to freezer plate 10 and it is, therefore, necessary to apply a sufficient pushing force to this row of frozen products to break the frost bonding them to the freezer plate so that the frozen products may glide along the freezer plate towards the discharge opening. This pushing force is exerted by pusher bar 14 when it is brought from its retracted position this side of endless conveyor belt 12 into the position wherein it contacts the first row of products and then pushes on a few centimeters to its extended position on the other side of the conveyor belt.

The translatory position of pusher bar 14 is determined by means of encoder 30 which controls the reversal of the direction of rotation of the electric motor of unit 26 when the pusher bar has reached the pre-set extent of the forward stroke of the pusher bar, and stops the rotation of the motor when the pusher bar has reached its initial retracted position. The force required to detach frozen products 58 from freezer plate 10 is determined by the pressure in pneumatic jack 28. When the measured pressure in the jack exceeds a predetermined value, electric current to the motor may be cut and an alarm may be set off to alert an operator to the existence of an abnormal operating condition. Since it is easier to detach the frozen products from the freezer plate by a series of short pushes rather than one long push, it is advantageous to displace pusher bar 14 by pneumatic jack 28 in a series of alternating translatory movements after the pusher bar has been brought into contact with the row of products. An automatically or manually operated solenoid valve V enables the piston of jack 28 to be reciprocated for effectuating this alternating translatory movement of pusher bar 14. When the pusher bar is moved forwardly, endless conveyor belt 12 stands still and is not charged. As soon as the pusher bar has been retracted sufficiently to permit a row of products 11 to be frozen to be positioned on the conveyor belt, the belt is moved.

Products 11 are brought to conveyor belt 12 by a conveyor disposed upstream of the conveyor belt. A movable barrier is placed between the upstream conveyor and conveyor belt 12 and a photoelectric cell is placed downstream at a distance from the movable barrier equal to the length of the longest row of products 11 to be frozen on freezer plates 10. Abutment 54 positioned on conveyor belt 12 downstream of the photoelectric cell permits the row of products 11 to be delimited so that this row of products may be placed on the conveyor belt in front of freezer plate 10 to be charged. The contact of the row of products 11 with abutment 54 controls the energization of the electric motor of unit 26, causing pusher bar 14 to be moved forwardly and thus to push the row of products 11 to be frozen off endless conveyor belt 12, over sheet metal element 13 and into contact with the first row of frozen products 58 on horizontally aligned freezer plate 10. The further advance of the pusher bar causes the displacement of all the abutting rows of frozen products on freezer plate 10 towards the rear wall of the freezer housing and the last row of frozen products is pushed out and discharged through the discharge opening in the rear wall where the frozen products fall onto a discharge conveyor positioned at the rear of the freezer. As soon as the row of products 11 to be frozen has been charged onto freezer plate 10, encoder 30 causes the reversal of the direction of rotation of the electric motor of unit 26 whereby pusher bar 14 is retracted to its starting position, and the chain drive with pusher bar 14 is raised above the level of the conveyor belt by operation of jack 48. The above-described series of steps is repeated to charge the next row of products, the chain drive and pusher bar being returned to their lowered position at the end of a predetermined time of shorter duration than the time required for the complete retraction of the pusher bar.

The number of rows of products that may be charged onto a freezer plate is predetermined and the number of charged rows of products is counted at the barrier placed between the feeding conveyor and endless conveyor 12. When this number has been reached, the barrier remains closed and a new charging cycle is initiated only after a new freezer plate 10 has been raised to the level of endless conveyor belt 12.

In addition to the above-described operations, the apparatus may be used for discharging all the freezer plates before the freezer is defrosted. In this case, the pusher bar is incrementally advanced along the entire length of each freezer plate. The apparatus may also be used to clean the freezer plates after defrosting by replacing the pusher bar by a scraper attached to the chain drive for translatory movement along the freezer plates.

What is claimed is:

1. An apparatus for charging products to be frozen onto a freezer plate extending in a horizontal plane, which comprises (a) a support frame, (b) a conveyor means mounted on the support frame and arranged to place the products to be frozen in front of the freezer plate in said plane, and (c) means for transferring the products to be frozen in a translatory movement from the conveyor means onto the freezer plate, the transferring means comprising (1) a pusher bar arranged to engage the products to be frozen on the conveyor means, (2) a chain drive arranged to apply a pushing force to the pusher bar engaging the products to be frozen and to impart the translatory movement thereto, the chain drive comprising chains to which the pusher bar is attached and driving sprockets about which the chains are trained, the chains having links short enough to enable the chains to engage the sprockets over about a quarter of a circle and the sprockets being affixed to a rotary shaft, (3) a motor unit floatingly mounted on the rotary shaft and comprising a torque arm, the motor unit being operable to apply a rotary force to the shaft, and (4) a dynamometer connecting the torque arm to the support frame and controlling the operation of the motor unit so as to limit the pushing force applied to the pusher bar.

2. The apparatus of claim 1, wherein the dynamometer is constituted by a pneumatic jack adapted to impart alternating movement to the torque arm, and further comprising means for measuring the air pressure in the jack.

3. The apparatus of claim 2, further comprising means for controlling the alternating movements of the jack.

4. The apparatus of claim 1, wherein the chains define a course extending in the horizontal plane and the chain links are hinged to each other by axles of articulation, and further comprising slide blocks supporting the chains along said course and mounted on the axles of articulation in a manner to maintain the chain links spaced from the surface along which the slide blocks glide, the slide blocks being platelets of a material having a low coefficient of friction.

5. The apparatus of claim 1, wherein the sprocket gears are spaced from the conveyor means in said horizontal plane, and further comprising rectilinear guides supporting the chains between the driving sprockets and the conveyor means, the rectilinear guides being mounted rotatively about the rotary shaft, and means for turning the rectilinear guides about the rotary shaft and thereby to lift the chains and the pusher bar attached thereto above said horizontal plane.

6. The apparatus of claim 5, further comprising a tube coaxially surrounding the rotary shaft and being rotatable thereabout, the rectilinear guides being affixed to the rotatable tube, and the turning means comprising a jack and an arm affixed to the rotatable tube and connected to the jack.

* * * * *